US007231158B2

(12) United States Patent
Hiraoka et al.

(10) Patent No.: US 7,231,158 B2
(45) Date of Patent: Jun. 12, 2007

(54) IMAGE FORMING APPARATUS HAVING A FIXING DEVICE WITH IMPROVED TEMPERATURE DETECTION FEATURES

(75) Inventors: Chikara Hiraoka, Hitachi (JP); Toru Hanashima, Hitachi (JP); Tetsuji Takegoshi, Hitachi (JP); Goro Sato, Tsuchiura (JP); Shogo Matsumoto, Hitachi (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 11/010,269

(22) Filed: Dec. 14, 2004

(65) Prior Publication Data

US 2005/0141914 A1 Jun. 30, 2005

(30) Foreign Application Priority Data

Dec. 24, 2003 (JP) ..... 2003-427585

(51) Int. Cl.
*G03G 15/20* (2006.01)

(52) U.S. Cl. ..... 399/69

(58) Field of Classification Search ..... 399/33, 399/44, 67, 69, 320, 328, 335; 374/100, 374/153

See application file for complete search history.

(56) References Cited

U.S. PATENT DOCUMENTS 5,281,793 A * 1/1994 Gavin et al. ..... 219/216
5,287,155 A * 2/1994 Arai et al. ..... 399/69
5,299,870 A * 4/1994 Moritani ..... 374/153
5,585,896 A * 12/1996 Yamazaki et al. ..... 399/174
5,765,075 A * 6/1998 Yamamoto ..... 399/69
6,167,216 A * 12/2000 Hori ..... 399/69
2002/0018663 A1* 2/2002 Furukawa et al. ..... 399/69
2002/0041772 A1* 4/2002 Makihira et al. ..... 399/69
2003/0162118 A1* 8/2003 Komatsu et al. ..... 430/124
2003/0231894 A1* 12/2003 Matsuno et al. ..... 399/69
2004/0028423 A1* 2/2004 Hashiguchi et al. ..... 399/69

FOREIGN PATENT DOCUMENTS

JP 2003-98899 4/2003

* cited by examiner

*Primary Examiner*—Quana Grainger
(74) *Attorney, Agent, or Firm*—McGuireWoods LLP

(57) ABSTRACT

An image forming apparatus includes a fixing device having a pressure roller. The surface of the pressure roller is coated with a PFA resin and has an average surface roughness Ra of 0.05 to 0.13 μm. A thermister is provided to detect the surface temperature of the pressure roller. The thermister includes a metal plate, a resister element attached to the metal plate, and a pair of fluorocarbon-resin films sandwiching the metal plate and the resister element. The fluorocarbon-resin film has a thickness of 15 μm to 80 μm.

20 Claims, 2 Drawing Sheets

IMAGE FORMING APPARATUS HAVING A FIXING DEVICE WITH IMPROVED TEMPERATURE DETECTION FEATURES

BACKGROUND OF THE INVENTION

1. Field of the Invention

The present invention relates to a fixing device used in an image forming apparatus, such as copying machines and printers.

2. Related Art

A fixing device used in an image forming apparatus is usually provided with temperature detecting means so as to maintain the surface temperature of a heat roller at a predetermined temperature as disclosed in Japanese Patent-Application Publication No. 2003-98899. As such temperature detecting means, there have been proposed contact type detecting means that includes a contact type thermister for detecting the surface temperature while contacting the surface of the heat roller and non-contact type detecting means that includes a non-contact type thermister for detecting the surface temperature without contacting the heat roller.

When the contact type detecting means is used, the thermister causes damages to the heat roller by contacting the same. Therefore, the thermister is usually arranged to contact an end portion of the heat roller outside of a sheet passage portion so that the damages to the heat roller do not affect the quality of printed images. The sheet passage portion of the heat roller indicates a region of the heat roller where a paper sheet contacts when passing by the heat roller.

However, using the contact type detecting means has the following disadvantage. That is, it takes time for heat to transfer in the axial direction of the heat roller. Although the sheet passage portion of the heat roller, which contacts a sheet and melts toner on the sheet, is decreased in its temperature as the sheet contacts the sheet passage portion, a portion of the heat roller other than the sheet passage portion does not decrease in its temperature in the same manner as the sheet passage portion because such a portion does not contact the sheet. As a result, the temperature of the heat roller detected by the contact type thermister differs from the temperature of the heat roller at the sheet passage portion. This makes it difficult to maintain the sheet passage portion of the heat roller at a predetermined temperature.

It has been proposed to switch the surface temperature of the heat roller according to the type of paper sheet. However, it is difficult to precisely control the temperature of the sheet passage portion of the heat roller based only on the detection result of the contact type thermister in contact with the heat roller at the non-sheet passage portion.

If the temperature of the sheet passage portion of the heat roller is lower than the predetermined temperature, then toner on a paper sheet is not completely melted, resulting in a cold offset phenomenon where the toner falls off the paper sheet. On the other hand, if the temperature is higher than the predetermined temperature, then a hot offset phenomenon in which the melted toner adheres to the heat roller and a phenomenon in which the paper sheet winds around the heat roller occur.

On the other hand, the non-contact type detecting means includes one that detects the temperature using infrared rays and one that detects radiation heat. Because the non-contact type detecting means can detect the temperature of the heat roller without contacting the heat roller, the non-contact type detecting means can be disposed to the side of the sheet passage portion of the heat roller without casing damages to the heat roller. Therefore, the non-contact type detecting means can detect the temperature more precisely than the above-described contact type detecting means. However, the non-contact type detecting means has the following disadvantages.

The non-contact type detecting means using the infrared rays includes a protection member for preventing the effects of air currents or atmospheric motions occurring near a detection element on temperature detection, causing the detecting means to have a large size and a large number of components. This makes it difficult to manufacture detecting means at reduced cost.

The non-contact type detecting means using the radiation heat usually includes a detection element, which is the same type of detection element as that used in the contact type thermister, disposed to the side of the heat roller while avoiding direct contact with the heat roller, for detecting the surface temperature of the heat roller via the air space. Thus, the detecting means has the simple configuration and has advantages in terms of providing compact and less expensive detecting means.

However, because the temperature is detected via the air space, there is time delay between when the surface temperature of the heat roller is changed and when this change in the surface temperature is actually detected by the detection element. As a result, it is difficult to maintain the surface temperature of the heat roller constant, causing the cold offset problems and hot offset problems. In a worse case, paper jams occur due to a paper sheet winding around the heat roller.

SUMMARY OF THE INVENTION

In the view of foregoing, it is an object of the present invention to overcome the above problems, and also to provide a compact and less-expensive fixing device capable of precisely detecting a surface temperature of a heat roller without causing damages to the heat roller, and to provide an image forming apparatus including the fixing device.

In order to attain the above and other objects, according to one aspect of the present invention, there is provided a fixing device used in an image forming apparatus. The fixing device includes a heat roller and temperature detecting means for detecting the surface temperature of the heat roller. The heat roller includes a core member, a heater disposed inside the core member, a roller member covering the core member, and an outer layer covering over the surface of the roller member. The outer layer is made of Tetrafluoroethylene-Perfluoro(alkoxy Vinyl Ether)-Copolymer. The temperature detecting means includes a metal plate, a temperature detecting element attached to one surface of the metal plate, and a fluorocarbon-resin film attached to the other surface of the metal plate. The fluorocarbon-resin film of the temperature detecting means contacts the outer surface of the heat roller.

According to a different aspect of the present invention, there is provided a fixing device used in an image forming apparatus. The fixing device includes a heat roller and temperature detecting means for detecting the surface temperature of the heat roller. The heat roller includes a core member, a heater disposed inside the core member, a roller member covering the core member, and an outer layer covering over the surface of the roller member. The temperature detecting means includes a metal plate, a temperature detecting element attached to one surface of the metal plate, and a fluorocarbon-resin film attached to the other surface of the metal plate. The fluorocarbon-resin film has an outer layer made of Tetrafluoroethylene-Perfluoro(alkoxy Vinyl Ether)-Copolymer, and fluorocarbon-resin film contacts the outer surface of the heat roller.

According to still different aspect of the present invention, there is provided an image forming apparatus including a heat roller and temperature detecting means for detecting the surface temperature of the heat roller. The heat roller includes a core member, a heater disposed inside the core member, a roller member covering the core member, and an outer layer covering over the surface of the roller member. The outer layer is made of Tetrafluoroethylene-Perfluoro (alkoxy Vinyl Ether)-Copolymer. The temperature detecting means includes a metal plate, a temperature detecting element attached to one surface of the metal plate, and a fluorocarbon-resin film attached to the other surface of the metal plate. The fluorocarbon-resin film of the temperature detecting means contacts the outer surface of the heat roller.

There is also provided an image forming apparatus including a heat roller and temperature detecting means for detecting the surface temperature of the heat roller. The heat roller includes a core member, a heater disposed inside the core member, a roller member covering the core member, and an outer layer covering over the surface of the roller member. The temperature detecting means includes a metal plate, a temperature detecting element attached to one surface of the metal plate, and a fluorocarbon-resin film attached to the other surface of the metal plate. The fluorocarbon-resin film has an outer layer made of Tetrafluoroethylene-Perfluoro (alkoxy Vinyl Ether)-Copolymer, and the fluorocarbon-resin film contacts the outer surface of the heat roller.

PREFERRED EMBODIMENT OF THE PRESENT INVENTION

An image forming apparatus according to an embodiment of the present invention will be described with reference to the accompanying drawings.

Figure 1:
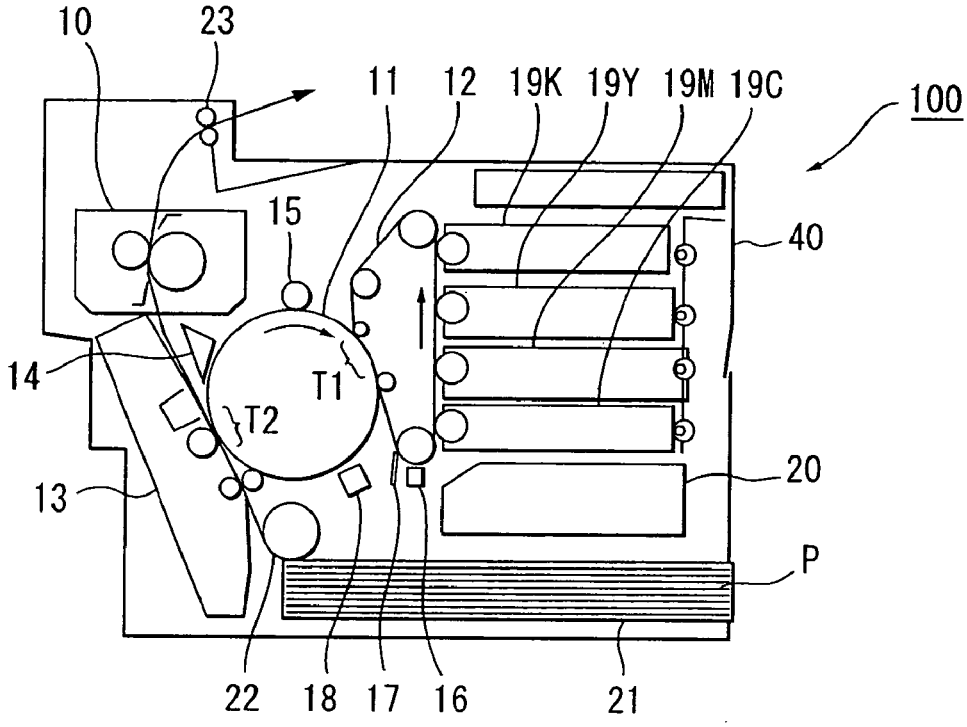
FIG. 1 is a plan view of an image forming apparatus according to an embodiment of the present invention.

As shown in FIG. 1, an image forming apparatus 100 includes a casing 40, an intermediate transfer member 11, a photosensitive member 12, a transfer device 13, a separating member 14, a cleaning member 15, a charger 16, a cleaning member 17, and a residual-charge removing member 18.

The intermediate transfer member 11 is disposed in approximately the center of the casing 40. The intermediate transfer member 11 is driven to rotate in a direction indicated by an arrow. The photosensitive member 12, the transfer device 13, the separating member 14, and the cleaning member 15 are disposed around the intermediate transfer member 11. The photosensitive member 12 is driven to rotate in a direction indicated by an arrow. The charger 16, the cleaning member 17, and the residual-charge removing member 18 are disposed around the photosensitive member 12. During printing, a transfer bias is applied to the photosensitive member 12 with respect to the intermediate transfer member 11, and also a transfer bias is applied to the transfer device 13 with respect to the intermediate transfer member 11.

The image forming apparatus 100 further includes four developing units 19K, 19Y, 19M, 19C, an irradiation unit 20, a sheet cassette 21, a sheet supply member 22, a fixing unit 10, and sheet discharge rollers 23. The developing units 19C, 19M, 19Y, 19K are arranged in the vertical alignment with each other, and each contains respective one of four different colors of toner, i.e., cyan, magenta, yellow, and black toner, which is colored fine powder. The irradiation unit 20 is disposed below the developing unit 19C. The sheet cassette 21 is located below the irradiation unit 20 and supports a stack of paper sheets P. The sheet supply member 22 is disposed near one end of the sheet cassette 21. The fixing unit 10 and the sheet discharge rollers 23 are disposed in the upper section of the casing 40.

With this configuration, while the photosensitive member 12 rotates in the counterclockwise direction in FIG. 1, the charger 16 uniformly charges the surface of the photosensitive member 12. Then, the irradiation unit 20 irradiates the surface of the photosensitive member 12 to a light generated dot by dot based on such image data as data received from a personal computer (not shown) or a scanner (not shown), thereby forming an electrostatic latent image on the photosensitive member 12.

Next, the electrostatic latent image is transformed into a cyan toner image by toner supplied from the developing unit 19C. When the toner image formed on the photosensitive member 12 reaches a first transfer position T1 as the photosensitive member 12 rotates, the toner image is transferred onto the surface of the intermediate transfer member 11 due to the transfer bias between the photosensitive member 12 and the intermediate transfer member 11. The residual-charge removing member 18 irradiates a portion of the photosensitive member 12 passed through the first transfer position T1 to a light so as to decrease a potential of the portion of the photosensitive member 12 to a value lower than a predetermined value. In this manner, the electrostatic latent image is erased from the photosensitive member 12. Then, the cleaning member 17 removes, from the photosensitive member 12, toner that remains on the photosensitive member 12 without being transferred onto the intermediate transfer member 11 at the first transfer position T1. In this manner, the photosensitive member 12 is returned to the state in which a next toner image can be formed thereon.

The above process is repeated for each of the remaining colors using the corresponding developing units 19M–19K, such that toner images in respective colors are transferred onto a toner image(s) previously transferred onto the intermediate transfer member 11. As a result, full-color toner image is formed on the intermediate transfer member 11.

The full-color toner image formed on the intermediate transfer member 11 is transferred at a second transfer position T2 by the transfer device 13 onto a paper sheet P supplied from the sheet cassette 21 by the sheet supply member 22. The paper sheet P transferred with the toner image is then separated from the intermediate transfer member 11 by the separating member 14 and conveyed to the fixing unit 10. The fixing unit 10 thermally fixes the toner image onto the paper sheet P as the paper sheet P passes through the fixing unit 10, and the sheet discharge rollers 23 discharge the paper sheet P out of the casing 40.

Figure 2:
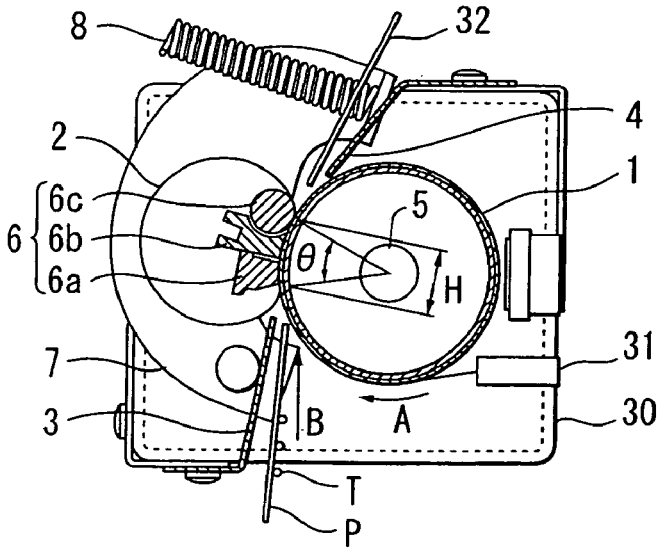
FIG. 2 is a plan view of a fixing device of the image forming apparatus of FIG. 1.

Next, the fixing unit 10 will be described in detail. As shown in FIG. 2, the fixing unit 10 includes a heat roller 1, a pressure belt 2, a pressure unit 6, a feed guide 3, a separation guide 4, and a side plate 30.

Figure 3:
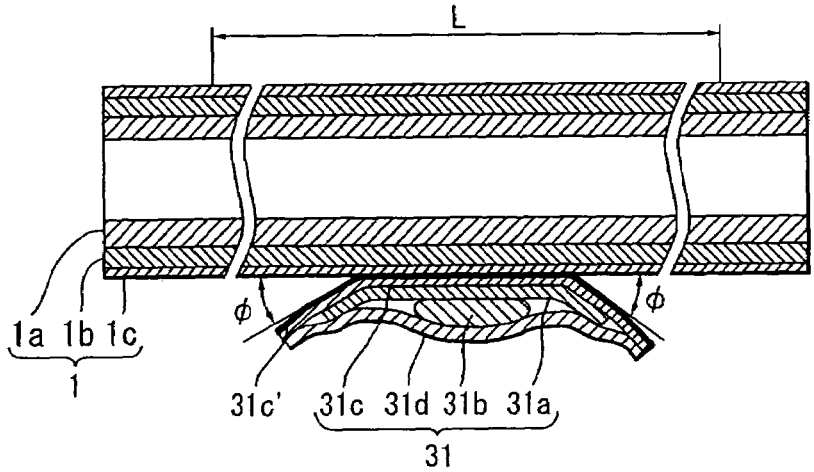
FIG. 3 is a cross-sectional view of a heat roller and a thermister of the fixing device of FIG. 2.

The heat roller 1 is a resilient roller having an outer diameter of 40.4 mm. The average surface roughness Ra of the heat roller 1 is set to 0.05 μm to 0.13 μm, and preferably 0.07 μm to 0.10 μm for reasons described later. The heat roller 1 is supported by the side plate 30 via a bearing (not shown) so as to be driven to rotate by a gear (not shown) in a direction indicated by an arrow A. As shown in FIGS. 2 and 3, the heat roller 1 includes a core member 1*a*, a silicon rubber layer 1*b* covering over the core member 1*a*, and a PFA layer 1*c* formed of Tetrafluoroethylene-Perfluoro (alkoxy Vinyl Ether)-Copolymer (PFA), and a heater 5 disposed inside the core member 1*a*. The core member 1*a* is formed from aluminum to have a thickness of 1.0 mm. The silicon rubber layer 1*b* has a JIS hardness of 20 degrees and a thickness of 0.8 mm. The PFA layer 1*c* has a thickness of 30 μm and covers over the surface of the silicon rubber layer 1*b* for facilitating toner to be separated from the heat roller 1. The heater 5 generates heat for melting toner.

The pressure belt 2 is a seamless belt having a thickness of 80 μm, formed from polyimide to have a ring shape with an inner diameter of 30 mm. The surface of the pressure belt 2 is coated with a PFA layer (not shown) having a thickness of 30 μm so as to facilitate toner to be separated from the pressure belt 2. Toner may cling to the pressure belt 2 when toner clinging on the heat roller 1 transfers onto the pressure belt 2, when a duplex printing is performed, or the like, and toner clinging onto the pressure belt 2 may contaminate the rear surface of a paper sheet P. Coating the pressure belt 2 with the PFA layer prevents such contamination.

The pressure unit 6 includes pressure members 6*a*, 6*b* and a pressure roller 6*c*. The pressure belt 2 is looped around the pressure members 6*a*, 6*b* and the pressure roller 6*c*.

The fixing unit 10 further includes a pressure arm 7 and a pressure spring 8 that urge the pressure belt 2 such that the pressure belt 2 contacts the heat roller 1 with a wrapping angle θ, thereby defining a contacting portion H therebetween where toner is melted.

The separation guide 4 is disposed on the downstream side of the contacting portion H with respect to a conveying direction B in which a paper sheet P is conveyed.

With this configuration, a paper sheet P with toner T transferred thereon is conveyed in the conveying direction B, and contacts the contacting portion H of the heat roller 1 where the toner T is thermally fixed to the paper sheet P. Then, the paper sheet P is separated from the heat roller 1 by the separation guide 4 and then discharged outside of the fixing unit 10.

As shown in FIG. 2, the image forming device 100 further includes a contact-type thermister 31 for detecting the surface temperature of the heat roller 1 with a high precision. As shown in FIG. 3, the contact-type thermister 31 is disposed to contact the heat roller 1 at approximately the center of a sheet passing area L in the lengthwise direction of the heat roller 1. Note that the sheet passing area L of the heat roller 1 is an area which the paper sheet P passes by the heat roller 1 while contacting with.

Figure 4:
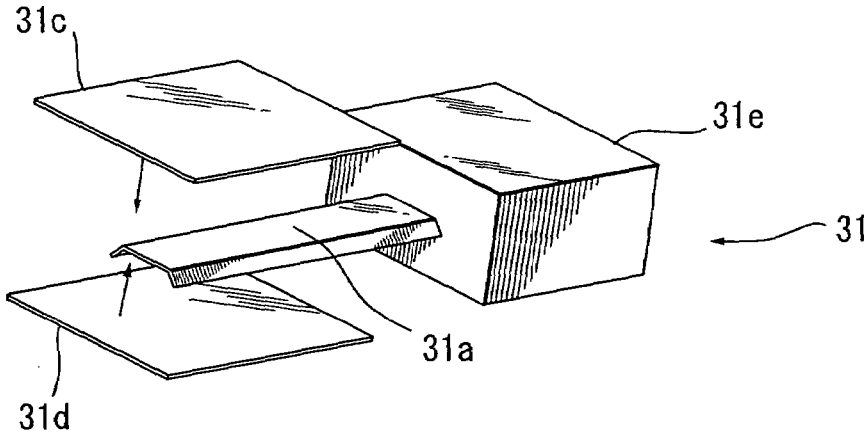
FIG. 4 is an exploded perspective view of the thermister.

The thermister 31 includes a plate 31*a* formed of stainless steel to a thickness of 0.1 mm, a resister element 31*b* attached to the side of the plate 31*a* for detecting temperature, fluorocarbon-resin films 31*c* and 31*d* sandwiching the plate 31*a* and the resister element 31*b*, and a holder 31*e* (FIG. 4) for supporting the plate 31*a* and a lead wire (not shown) of the resister element 31*b*. The holder 31*e* is formed of heat-resisting resin. In this embodiment, a Board Sensor PT7S-312 manufactured by Shibaura Electronics Co., Ltd. is used as the plate 31*a* and the resister element 31*b*. That is, the Board Sensor PT7S-312 manufactured by Shibaura Electronics Co., Ltd. include a plate (31*a*) and a resister element (31*b*) attached to the side of the plate (31*a*).

The fluorocarbon-resin film 31*c* has a PFA layer 31*c*' on its surface and has a total thickness of 0.015 mm to 0.08 mm and an average surface roughness Ra of 0.2 μm or less, preferably 0.15 μm or less.

The fluorocarbon-resin film 31*c* is supported by the plate 31*a* such that the end portions of the fluorocarbon-resin film 31*c* form an angle ϕ of 5° or greater, preferably 10° to 60°, with respect to the edge line of the heat roller 1 so as to prevent the edges of the fluorocarbon-resin film 31*c* from causing damages to the heat roller 1 and to prevent toner from accumulating on the edges of the fluorocarbon-resin film 31*c*. Specifically, in order to prevent the edges of the fluorocarbon-resin film 31*c* from causing damage to the heat roller 1 and to prevent toner from accumulating on the edges of the fluorocarbon-resin film 31*c*, a gap between the heat roller 1 and the edge of the fluorocarbon-resin film 31*c* should be at least 0.3 mm. Because each of bent portions of the fluorocarbon-resin film 31*c* at the respective edges (portion between and edge and a point at which the fluorocarbon-resin film 31*c* is bent) has the length of 3.5 mm to 5 mm in this embodiment, the angle ϕ should be preferably 5° or greater. However, taking deformation of the fluorocarbon-resin film 31*c* into consideration, the gap between the heat roller 1 and the edge of the fluorocarbon-resin film 31*c* is preferably at least 0.5 mm. In this case, the angle ϕ should be 10° or greater. On the other hand, if the angle ϕ is greater than 60°, then corners of the fluorocarbon-resin film 31*c* at which the fluorocarbon-resin film 31*c* is bent will be sharp, and these sharp corners of the fluorocarbon-resin film 31*c* may damage the surface of the heat roller 1.

The fluorocarbon-resin film 31*d* has the same configuration as the fluorocarbon-resin film 31*c* and is attached to the fluorocarbon-resin film 31*c*, thereby preventing the fluorocarbon-resin film 31*c* from being detached from the plate 31*a* due to the sliding contact with the heat roller 1. In this embodiment, the fluorocarbon-resin films 31*c* and 31*d* have the width of about 12 mm with respect to the lengthwise direction of the heat roller 1.

In this embodiment, PFA Adhesive Tape No. 813 manufactured by Teraoka Seisakusho Co., Ltd. is used as the fluorocarbon-resin films 31*c* and 31*d*. However, because the fluorocarbon-resin film 31*d* does not contact the heat roller 1, the fluorocarbon-resin film 31*d* could be different from the fluorocarbon-resin film 31*c*. However, it is necessary that the coefficient of linear expansion of the fluorocarbon-resin film 31*d* is the same or less than that of the fluorocarbon-resin film 31*c* and that the difference between the coefficient of linear expansion of the fluorocarbon-resin film 31*d* and that of the fluorocarbon-resin film 31*c* is $4\times10^{-5}$/° C. or less.

Note that if the coefficient of linear expansion of the fluorocarbon-resin film 31*d* is greater than that of the fluorocarbon-resin film 31*c*, then the fluorocarbon-resin film 31*d* stretches by the greater extent than the fluorocarbon-resin film 31*c*. As a result, the end portions of the fluorocarbon-resin film 31*c* move toward and contact the heat roller 1, causing damages to the heat roller 1.

Also, if the difference in linear expansions between the fluorocarbon-resin films 31*c* and 31*d* is 0.08 mm or greater, the films 31*c* and 31*d* deform due to bimetal effect. The edges of thus deformed film 31*c* may contact and damage the pressure roller 1. In order to prevent such a problem, the difference in the coefficient of linear expansions is set to $4\times10^{-5}$/° C. or less, because the fluorocarbon-resin films 31*c* and 31*d* of the present embodiment have the width of 12 mm as mentioned above, and because the surface temperature of the heat roller 1 is maintained at about 180° C. during operations.

With this configuration, the resister element 31*b* contacts the sheet-passing area L of the heat roller 1 via the fluorocarbon-resin film 31*c* having the thin thickness of 0.015 mm to 0.08 mm and the plate 31*a* formed of stainless steel having an excellent thermal conductivity. Therefore, the resister element 31*b* can detect the temperature of the heat roller 1 at the sheet passing area L with excellent responsiveness. Also, because the surface of the heat roller 1 is coated with the PFA layer 1*c* having the thickness of 30 μm and the average surface roughness Ra of 0.05 μm to 0.13 μm, and because the fluorocarbon-resin film 31*c* that directly contacts the heat roller 1 has the thickness of 0.015 mm to 0.08 mm and the average surface roughness Ra of 0.2 μm or less, the thermister 31 is prevented from causing damages to the heat roller 1 due to sliding contact between the thermister 31 and the heat roller 1, and also the abrasion of the heat roller 1 due to such a sliding contact can be prevented. As a result, degradation of images formed on a paper sheet P can be prevented.

Damages to the heat roller 1 have been tested in the following experiments.

Scratches on the surface of the heat roller 1 caused by the sliding contact with the thermister 31 greatly depend on a contact load of the thermister 31 against the heat roller 1, a surface roughness of the thermister 31, and a hardness of the surface of the thermister 31. Note that the contact load of the thermister 31 against the heat roller 1 should be set to a certain amount or greater for compensating attachment error of the thermister 31 and variation in temperature responsiveness of the thermister 31. In this embodiment, the contact load of the thermister 31 is set to 5 g.

<First Experiment>

In this experiment, test printing operations were performed to print 250 sheets P of paper with a blue image such that the entire surface of each sheet P is printed to blue color, while varying the material, thickness, hardness, and surface roughness of surface material (such as fluorocarbon-resin film 31*c*) of the thermister 31 that directly contacts the heat roller 1. In this experiment, sheets 4024-241b manufactured by Xerox Corporation were used as paper sheets P. Then, surface roughness of the heat roller 1, the amount of toner clinging on the thermister 31, and image quality were measured/observed after the test printing operations. Table T1 shows the results of the experiment.

TABLE T1

| | TEST NO. | | | | |
|---|---|---|---|---|---|
| | NO. 1 | NO. 2 | NO. 3 | NO. 4 | No. 5 |
| MATERIAL OF SURFACE LAYER OF THERMISTER | FLUOROCARBON-RESIN WITH PFA | PFA COAT | FLUOROCARBON-RESIN WITH PTFE | PTFE COAT | STAINLESS STEEL |
| THICKNESS OF SURFACE LAYER OF THERMISTER (mm) | 0.08 | 0.015–0.02 | 0.08 | 0.015–0.02 | — |
| HARDNESS OF SURFACE MATERIAL OF THERMISTER (Hv) | 1.5 | 9 | 1.7 | 8 | 458 |
| SURFACE ROUGHNESS Ra OF THERMISTER (μm) | 0.05 | 2.1 | 0.28 | 0.34 | 0.22 |
| SURFACE ROUGHNESS Ra OF HEAT OLLER (μm) | 0.11 | 0.32 | 0.12 | 0.24 | 0.14 |
| TONER AMOUNT CLINGING ON THERMISTER | LITTLE | SLIGHTLY A LOT | SLIGHTLY A LOT | A LOT | VERY A LOT |
| IMAGE QUALITY (SHEEN LINES) | ○ | X | ○ | X | ○ |

Specifically, in the test No. 1, a fluorocarbon-resin film coated with PFA layer is attached to the plate 31*a* as the surface material. In the test No. 2, PFA is directly coated over the plate 31*a* as the surface material. In the test No. 3, a fluorocarbon-resin film coated with a polytetrafluoroethylene (PTFE) layer is attached to the plate 31*a* as the surface material. In the test No. 4, PTFE is directly coated over the plate 31*a* as the surface material. In the test No. 5, the plate 31*a* was directly brought into contact with the heat roller 1 without attached or coated with anything. As shown in Table 1, the surface materials in the test Nos. 1 to 4 have the total thickness of 0.015 mm to 0.08 mm.

The hardness of the surface material of the thermister 31 that directly contacts the heat roller 1 was measured, as the hardness of the surface material, before the test printing operations were performed. The hardness was measured using a micro Vickers hardness meter by applying the load of 10 g for 15 sec. The average surface roughness Ra of the surface material was also measured before the test printing operations.

After the test printing operations were performed, the average surface roughness Ra of a region of the heat roller 1 that slidingly contacts the thermister 31 was measured as the surface roughness of the heat roller 1. A greater surface roughness Ra of the heat roller 1 indicates greater damage to the heat roller 1. Note that the initial surface roughness Ra of the heat roller 1 was about 0.03 μm. The amount of toner clinging on the thermister 31 was evaluated through visual observation after the test printing operations.

Image qualities were evaluated in the following manner. After the test printing operations, the entire surface of a thick paper sheet P (Springhi 11-901b manufactured by International Paper Company) having the smoothness of 30 sec and basic weight of 160 g/m$^2$ was printed to blue color. Then, if a sheen line in the printed image was easily recognized by visual observation, then the image quality was evaluated as X. If such a sheen line in the printed image was visually observed only when very closely observed, then the image quality was evaluated as ○.

Note that the sheen line appears in a printed image due to the difference in toner density between a portion of the image corresponding to the sliding-contact portion of the heat roller 1 with respect to the thermister 31 and a portion of the image corresponding to the other portion of the heat roller 1.

As will be understood from Table T1, it is preferable that the surface material of the thermister 31 be smooth and soft in order to reduce damages to the surface of the heat roller 1. Also, when the surface roughness Ra of the heat roller 1 after the test printing operations was 0.14 μm or less, no serious adverse effect was caused on image quality. Therefore, the surface material of the thermister 31 preferably has the average surface roughness Ra of 0.2 μm, which is an average of the average surface roughness Ra of 0.15 μm, 0.28 μm, and 0.22 μm, or less and more preferably of 0.15 μm or less.

In this embodiment, the Vickers hardness of the PFA layer 1*c* of the heat roller 1 is about 4 Hv. Therefore, it is preferable that the surface material of the thermister 31 have less hardness than the Vickers hardness of 4 Hv. According to the results shown in Table T1, the fluorocarbon-resin film with PFA layer (No. 1) or the fluorocarbon-resin film with PTFE layer (No. 3) is preferably used as the surface material of the thermister 31, in terms of the resultant surface roughness of the heat roller 1.

When the fluorocarbon-resin film with PFA layer was used as the surface material of the thermister 31, the least amount of toner was clinging on the thermister 31. This indicates that toner can be separated from the PFA layer formed on the fluorocarbon-resin film most easily. In other words, although the surface materials of test Nos. 1 and 2 both include PFA, the fluorocarbon-resin film with PFA layer has excellent separatability with respect to toner and causes less damage to the heat roller 1 compared to the PFA coat (test No. 2).

Thus, the fluorocarbon-resin film with PFA layer, which is soft and has a certain thickness and smooth surface, is optimal for the surface material of the thermister 31.

<Second Experiment>

In a second experiment, test printing operations were performed to print a black image having blackness of 5% on 250 sheets of paper 4024-241b manufactured by Xerox Corporation using the heat rollers 1 having different initial surface roughness Ra. In this experiment, the fluorocarbon-resin film with the PFA layer was used as the surface material of the thermister 31.

After the test printing operations, image qualities were evaluated. Table T2 shows the results.

TABLE T2

| INITIAL SURFACE ROUGHNESS Ra OF HEAT ROLLER (μm) | IMAGE QUALITY (NUMBER OF SHEETS PRINTED) | INITIAL TRANSPARENCY OF OHP IMAGE |
|---|---|---|
| 0.01–0.01 | X (250 SHEETS) | ○ |
| 0.05–0.07 | ○ (60,000 SHEETS) | ○ |
| 0.07–0.10 | ○ (60,000 SHEETS) | ○ |
| 0.10–0.13 | ○ (60,000 SHEETS) | ○ |
| 0.15–0.19 | X (250 SHEETS) | X |

The image qualities were evaluated in the same manner as in the first experiment. That is, after the printing operations, the entire surface of a thick paper sheet (Springhi 11-901b manufactured by International Paper Company) having the smoothness of 30 sec and basic weight of 160 g/m$^2$ was printed to blue color. Then, if a sheen line was easily recognized by visual observation, then the image quality was evaluated as X. If such a sheen line was only visually observed when closely observed, then the image quality was evaluated as ○.

Note that the number of sheets shown in the "image quality" column of Table T2 indicates the number of sheets that have been printed, including the sheets printed during the test printing operations, without (before) the sheen line was first observed. That is, when the initial surface roughness Ra of the heat roller 1 is 0.01 μm to 0.14 μm or 0.15 μm to 0.19 μm, the sheen line was easily observed after 250 sheets of paper were printed during the test printing operations. However, when the initial surface roughness Ra of the heat roller 1 is 0.05 μm to 0.07 μm, 0.07 μm to 0.10 μm, or 0.10 μm to 0.13 μm, the sheen line was recognized only when very closely observed after 60,0000 sheets of paper have been printed.

It should be understood from Table T2 that good printing quality can be obtained when the initial surface roughness Ra of the heat roller 1 is within a certain range, but the quality is degraded if the heat roller 1 has the initial surface roughness Ra excluded from this certain range.

One of conceivable reasons for this is that, as described above, the sheen line appears in a printed image due to the difference in toner density between a portion of the image corresponding to the sliding-contact portion of the heat roller 1 with respect to the thermister 31 and a portion of the image corresponding to the remaining portion of the heat roller 1. Therefore, if the surface roughness of the heat roller 1 is small, that is, if the heat roller 1 has a smooth surface, then the surface of the heat roller 1 in the sliding-contact region becomes rough more than that in the other region. As a result, the glossiness of images is reduced in the portion corresponding to the sliding-contact region of the heat roller 1, causing the sheen lines in printed images. On the other hand, if the surface roughness of the heat roller 1 is large, that is, if the heat roller 1 has a rough surface, then the surface of the heat roller 1 in the sliding-contact region becomes smoother than that in the other region. As a result, the glossiness of images is increased in the portion corresponding to the sliding-contact region of the heat roller 1, causing the sheen lines in printed images.

In the second experiment, the transparency of OHP images were also evaluated using OHP films (No. CG3700 manufactured by 3M) before the test printing operations were performed. More specifically, the OHP film was printed using yellow toner such that the entire surface of the film was printed to yellow color, and the transparency of the OHP image (image formed on the OHP film) was evaluated.

The transparency was evaluated as ○ when the transparency was equal to or greater than 60%, and evaluated as X if the transparency was less than 60%. Generally, if the transparency is equal to or greater than 60%, there would be no problem, but transparency of less than 60% makes a projected image undesirably dark. It should be understood from Table T2 that the initial surface roughness Ra of the heat roller 1 equal to or less than 13 μm can ensure the sufficient transparency of the OHP images. Note that the transparency of OHP images depends on the surface roughness Ra of the heat roller 1, and if the heat roller 1 has a rough surface, then the transparent of OHP films decreases.

From the above, it can be understood that the heat roller 1 preferably has the average surface roughness Ra of 0.05 μm to 0.13 μm, and more preferably of 0.07 μm to 0.10 μm.

While some exemplary embodiments of this invention have been described in detail, those skilled in the art will recognize that there are many possible modifications and variations which may be made in these exemplary embodiments while yet retaining many of the novel features and advantages of the invention.

Figure 5:
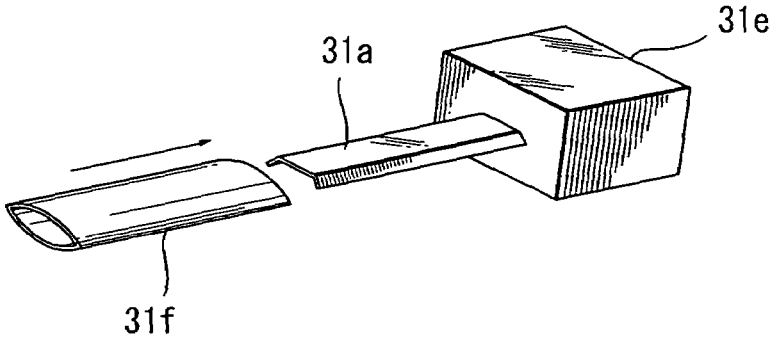
FIG. 5 is an explanatory view of a thermister according to a modification of the embodiment.

For example, in the above embodiment, the fluorocarbon-resin films 31*c* and 31*d* are attached to one another while sandwiching the plate 31*a* and the resister element 31*b* therebetween. However, as shown in FIG. 5, the thermister 31 could be produced by inserting the plate 31*a* attached with the resister element 31*b* into a heat-shrinkable PFA tube 31*f* and applying heat to the heat-shrinkable PFA tube 31*f*, casing the heat-shrinkable PFA tube 31*f* to shrink and bringing the same into intimate contact with the plate 31*a* and the resister element 31*b*.

Also, in the above embodiment, the plate 31*a* is formed of stainless steel. However, the plate 31 could be formed of metal other than stainless steel.

What is claimed is:

1. A fixing device used in an image forming apparatus, the fixing device comprising:

a heat roller including a core member, a heater disposed inside the core member, a roller member covering the core member, and an outer layer covering over a surface of the roller member, the outer layer being made of Tetrafluoroethylene-Perfluoro(alkoxy Vinyl Ether)-Copolymer; and a temperature detector that detects a surface temperature of the heat roller, the temperature detector includes a metal plate, a temperature detecting element attached to one surface of the metal plate, and a fluorocarbon-resin film attached to the other surface of the metal plate, wherein the fluorocarbon-resin film of the temperature detector comprises a film tape and contacts the outer surface of the heat roller.

2. The fixing device according to claim 1, wherein the outer layer of the heat roller has an average surface roughness Ra of 0.05 μm to 0.13 μm.

3. The fixing device according to claim 1, wherein the fluorocarbon-resin film has a total thickness of 15 μm to 80 μm.

4. The fixing device according to claim 1, wherein the fluorocarbon-resin film has a greater length than the metal plate, and an end portion of the fluorocarbon resin film forms an angle of 10° to 60° with respect to the edge line of the heat roller.

5. The fixing device according to claim 1, wherein the temperature detector further includes a film formed of material other than fluorocarbon resin and attached to the fluorocarbon-resin film; the difference between a coefficient of linear expansion of the fluorocarbon-resin film and a coefficient of linear expansion of the film is $4\times10^{-5}$/° C. or less; and the coefficient of linear expansion of the fluorocarbon resin film is greater than the coefficient of linear expansion of the film.

6. The fixing device according to claim 1, wherein the fluorocarbon-resin film has an average surface roughness Ra of 0.2 μm or less.

7. The fixing device according to claim 1, wherein a portion of the temperature detector that contacts the heat roller has a hardness less than a hardness of the surface of the heat roller.

8. An image forming apparatus comprising:

a heat roller including a core member, a heater disposed inside the core member, a roller member covering the core member, and an outer layer covering over the surface of the roller member, the outer layer being made of Tetrafluoroethylene-Perfluoro(alkoxy Vinyl Ether)-Copolymer; and a temperature detector that detects a surface temperature of the heat roller, the temperature detector includes a metal plate, a temperature detecting element attached to one surface of the metal plate, and a fluorocarbon-resin film attached to the other surface of the metal plate, wherein the fluorocarbon-resin film of the temperature detector comprises a film tape and contacts the outer surface of the heat roller.

9. The image forming apparatus claim 8, wherein the outer layer of the heat roller has an average surface roughness Ra of 0.05 μm to 0.13 μm.

10. The image forming apparatus according to claim 8, wherein the fluorocarbon-resin film has a total thickness of 15 μm to 80 μm.

11. The image forming apparatus according to claim 8, wherein the fluorocarbon-resin film has a greater length than the metal plate, and an end portion of the fluorocarbon resin film forms an angle of 10° to 60° with respect to the edge line of the heat roller.

12. The image forming apparatus according to claim 8, wherein the temperature detector further includes a film formed of material other than fluorocarbon resin and attached to the fluorocarbon-resin film; and the difference between a coefficient of linear expansion of the fluorocarbon-resin film and a coefficient of linear expansion of the film is $4\times10^{-5}$/° C. or less; and the coefficient of linear expansion of the fluorocarbon resin film is greater than the coefficient of linear expansion of the film.

13. The image forming apparatus according to claim 8, wherein the fluorocarbon-resin film has an average surface roughness Ra of 0.2 μm or less.

14. The image forming apparatus according to claim 8, wherein a portion of the temperature detector that contacts the heat roller has a hardness less than a hardness of the surface of the heat roller.

15. The fixing device according to claim 8, wherein the roller member has a recording medium passing region on which a recording medium passes, wherein the temperature detector contacts the recording medium passing region.

16. An image forming apparatus comprising:

a heat rolling including a core member, a heater disposed inside the core member, a roller member covering the core member, and an outer layer covering over the surface of the roller member; and a temperature detector that detects the surface temperature of the heat roller, the temperature detector includes a metal plate, a temperature detecting element attached to one surface of the metal plate, and a fluorocarbon-resin film attached to the other surface of the metal plate, wherein:

the fluorocarbon-resin film has an outer layer made of Tetrafluoroethylene-Perfluoro (alkoxy Vinyl Ether) Copolymer; and the fluorocarbon-resin film comprises a film tape and contacts the outer surface of the heat roller.

17. The image forming apparatus according to claim 16, wherein the fluorocarbon-resin film has a total thickness of 15 μm to 80 μm.

18. The image forming apparatus according to claim 17, wherein the outer layer of the heat roller is made of Tetrafluoroethylene-Perfluoro(alkoxy Vinyl Ether)-Copolymer and has an average surface roughness Ra of 0.05 μm to 0.13 μm.

19. The image forming apparatus according to claim 16, wherein the roller member has a recording medium passing region on which a recording medium passes, wherein the temperature detector contacts the recording medium passing region.

20. A fixing device used in an image forming apparatus, the fixing device comprising:

a heat roller including a core member, a heater disposed inside the core member, a roller member covering the core member, and an outer layer covering over a surface of the roller member, the outer layer being made of Tetrafluoroethylene-Perfluoro(alkoxy Vinyl Ether)-Copolymer; and a temperature detector that detects the surface temperature of the heat roller, the temperature detector including a metal plate, a temperature detecting element attached to one surface of the metal plate, and a second film, the first film and the second film sandwiching the metal plate and the temperature detecting element, wherein at least the first film comprises a fluorocarbon-resin film tape for contacting the outer surface of the heat roller.

* * * * *